United States Patent [19]

Wells et al.

[11] 4,003,491

[45] Jan. 18, 1977

[54] SYSTEM OF INTERCONNECTING CONTAINERS

[76] Inventors: Robert A. Wells, 4450 Harris Trail NW., Atlanta, Ga. 30327; Carl J. Strobe, 2831 Orchard Knob, Atlanta, Ga. 30309

[22] Filed: Nov. 12, 1975

[21] Appl. No.: 630,988

Related U.S. Application Data

[62] Division of Ser. No. 477,821, June 10, 1974, abandoned.

[52] U.S. Cl. ..... 220/23.4; 206/504; 215/10

[51] Int. Cl.[2] ..... B65D 21/02

[58] Field of Search ..... 220/23.4; 206/504; 215/10

[56] References Cited

UNITED STATES PATENTS

| | | | |
|---|---|---|---|
| 2,753,077 | 7/1956 | Greco | 206/504 |
| 2,974,841 | 3/1961 | Van Lee | 206/504 |
| 3,366,265 | 1/1968 | Hasselbarth | 220/23.4 |
| 3,367,486 | 2/1968 | Larson | 220/23.4 |
| 3,369,658 | 2/1968 | Hasselman | 220/23.4 |
| 3,374,917 | 3/1968 | Troy | 220/23.4 |
| 3,419,176 | 12/1968 | Lipfert | 220/23.4 |
| 3,683,549 | 8/1972 | Simmon | 220/23.4 |
| 3,815,281 | 6/1974 | Kander | 220/23.4 |

*Primary Examiner*—George E. Lowrance

[57] ABSTRACT

System for interconnecting containers into multiple-container groups, without requiring any packaging material. Complementary interconnecting structure is provided as an integral part of containers that can be interconnected in a vertical or end-to-end array, in a lateral or side-by-side array, or in combined vertical and lateral array. Numerous embodiments of container structure are disclosed for interconnecting containers into a multiple-container package having a desired vertical and/or lateral array.

6 Claims, 10 Drawing Figures

SYSTEM OF INTERCONNECTING CONTAINERS

This is a division of application Ser. No 477,821, filed June 10, 1974, now abandoned.

This invention relates in general to packaging, and in particular to a system for interconnective multipack packaging of containers without requiring wrapping or other packaging material.

Individual containers of beverages, foods, and other products have long been distributed and sold in multipack cartons or packages for the convenience of the consumer. The conventional distribution of canned in multipack cartons popularly known as six-packs, eight-packs, or the like, is but one example of multiple packaging of separate containers which are individually removed from the package and used.

Although multipack packaging of individual containers is convenient for the distributor and the consumer of such products, there are a number of disadvantages associated with multipack heretofore available in the art. One obvious disadvantage is the waste material which is provided by the opened and discarded multipack packaging material. Most multipack packages must be torn or ripped apart to remove the packaged containers, leaving bits of paper or other packaging material which frequently become litter. Even where containers are package with non-tearing packages, such as the well-known plastic loops through which ends of beverage cans are inserted, the discarded package material still provides a prolific source of potential litter. Still another disadvantage to multipack packages of the prior art is the cost involved in providing and forming the package material, and in inserting the individual containers within the package. The cost considerations of conventional multipack packaging have recently been accentuated by the rapidly-increasing costs of packaging materials such as paper and plastics. Moreover, money spent on providing multipack packaging material is generally unrecoverable, since no feasible way has been found to collect and recycle used packaging material (unlike metallic beverage cans, for example, which are more conducive to collection for recycling).

Accordingly, it is an object of the present invention to provide an improved system for multipack packaging of containers.

It is another object of the present invention to provide a system for interconnective packaging of multiple containers without disposable packaging material.

It is still another object of the present invention to provide multipack container interconnections through structural means integral with the individual containers.

Other objects and advantages of the present invention will become more readily apparent from the following description of the disclosed embodiements as illustrated in the Figures, wherein.

Stated in general terms, the present invention comprises containers provided with integral interconnective means which enables similarly equipped containers to be mutually interconnected to comprise a multipack package of several containers. The interconnective means on each container is complementary to interconnective means on one or more other containers, so that the containers can be interconnected together in end-to-end connection, in lateral or side-to-side connection, or in both end and side interconnection. Preferred embodiments of the present invention are disclosed in the context of containers for products such as beer and soft drinks, which may include a scored easy-open end structure. The end-connecting embodiments of the present invention maintain the scored opening structure out of contact with the ends of an adjacent interconnected container. The present invention includes containers having dissimilar complementary connective structure, referred to hereinafter as "paired containers," as well as containers having identical connective structure for interconnection with like containers.

Figure 2:
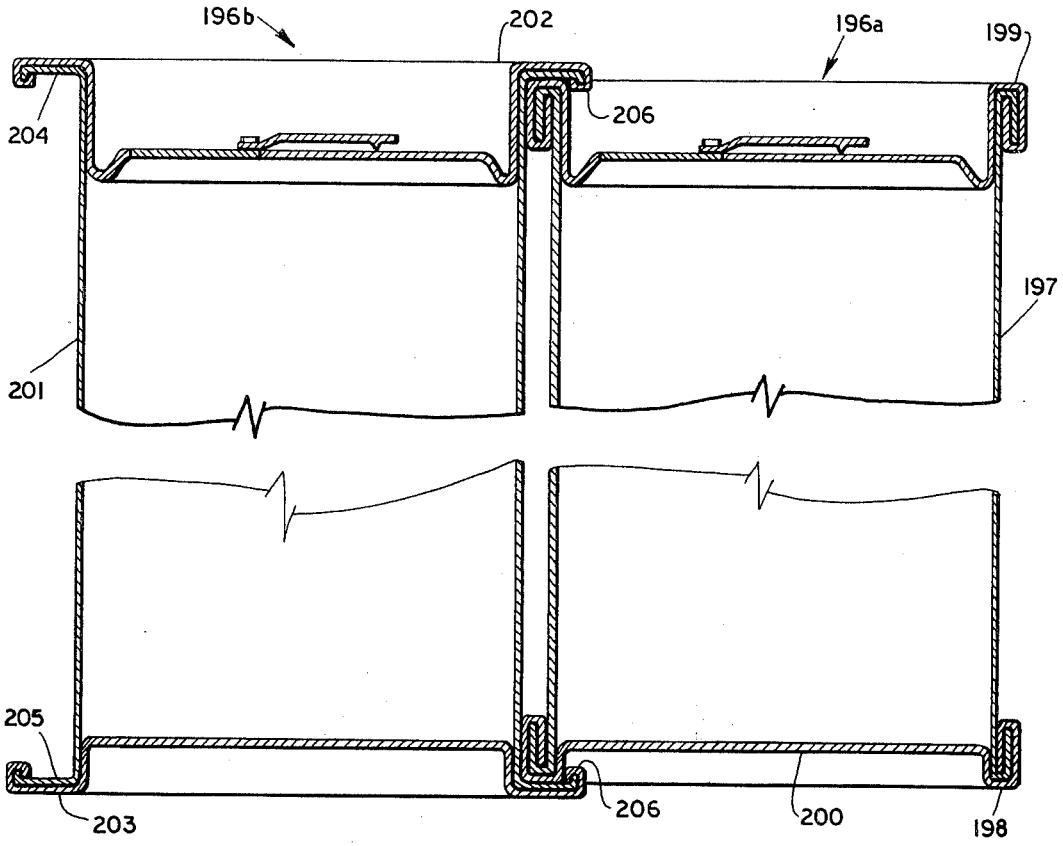
FIG. 2 is a vertical section view of the lateral-connecting containers of FIG. 1.
Figure 1:
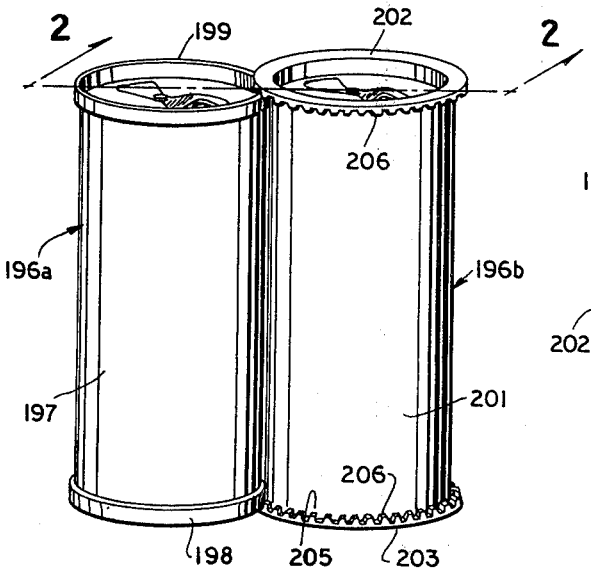
FIG. 1 is a pictorial view showing two lateral-connected containers according to a disclosed embodiment of the present invention.

The present invention is better understood by referring to the embodiments thereof that are disclosed herein, with initial reference taken to FIGS. 1 and 2, wherein there is shown the first of several disclosed embodiments of lateral-connecting containers according to the present invention. The embodiment of FIGS. 1 and 2 is exemplified by the paired containers **196*a* and 196*b*, designated respectively as a male container and a female container. The male container 196*a* can be a conventional beverage can, for example, having a cylindrical body 197 closed by bottom and top ends and having a bottom chime 198 and a top chime 199. Although the container 196*a* is shown in FIG. 30 as being a two-piece container having a bottom end 200 formed separately from the body 197, the container 196*a*** can alternatively be of one-piece construction as previously described.

The female container **196*b* also has a body 201 closed by a top end and a bottom end. It can be seen from FIGS. 1 and 2 that the top chime 202 and the bottom chime 203 of the female container 196*b* cooperatively engage the conventional top and bottom chimes 199 and 198, respectively, of the male container 196*a*. The top chime 202 of the container 196*b* is formed with an annular circumferential channel 204 surrounding the top end of the container body 201 and facing longitudinally along the body toward the bottom end of the container. The bottom chime 203 likewise has an annular circumferential channel 205 facing longitudinally upwardly to confront the top channel 204. A row of serrations 206, seen in FIG. 29, is formed in the extremity of each channel-defining portion of the chimes 202 and 203.**

The paired containers 196*a* and 196*b* are connected together in side-by-side lateral relation, as shown in FIGS. 1 and 2, by snap-in engagement of the top and bottom chimes 199 and 198 within the corresponding top and bottom channels 204 and 205. The longitudinal spacing between the channels 204 and 205 must be sufficient to receive the chimes of the male container 196*a* while allowing the serrations 206 surrounding the two channels to grip and interlock the chimes of the male container 196*a*. The two containers 196*a* and 196*b* are separated by grasping and laterally pulling apart the containers to unsnap the interconnection.

Figure 3:
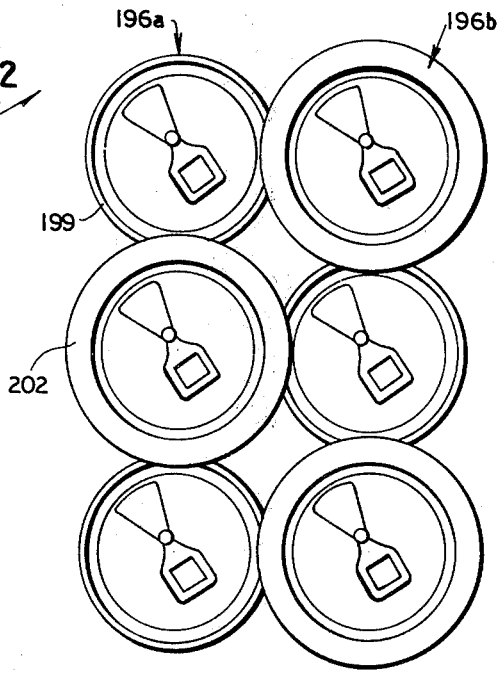
FIG. 3 is a top plan view showing an example of multiple lateral-connecting containers of the type shown in FIGS. 1 and 2.

Although the lateral-connecting embodiment described in FIGS. 1 and 2 requires dissimilar containers, it is shown in FIG. 3 that a plural number of such containers can be interconnected to form a multipack grouping of containers without requiring any wrapping or packaging material. A standard six-pack unit of interconnected containers is shown in FIG. 3, with the male-female orientation of adjacent paired containers being staggered to permit locking lateral connection between adjacent containers.

Figure 4:
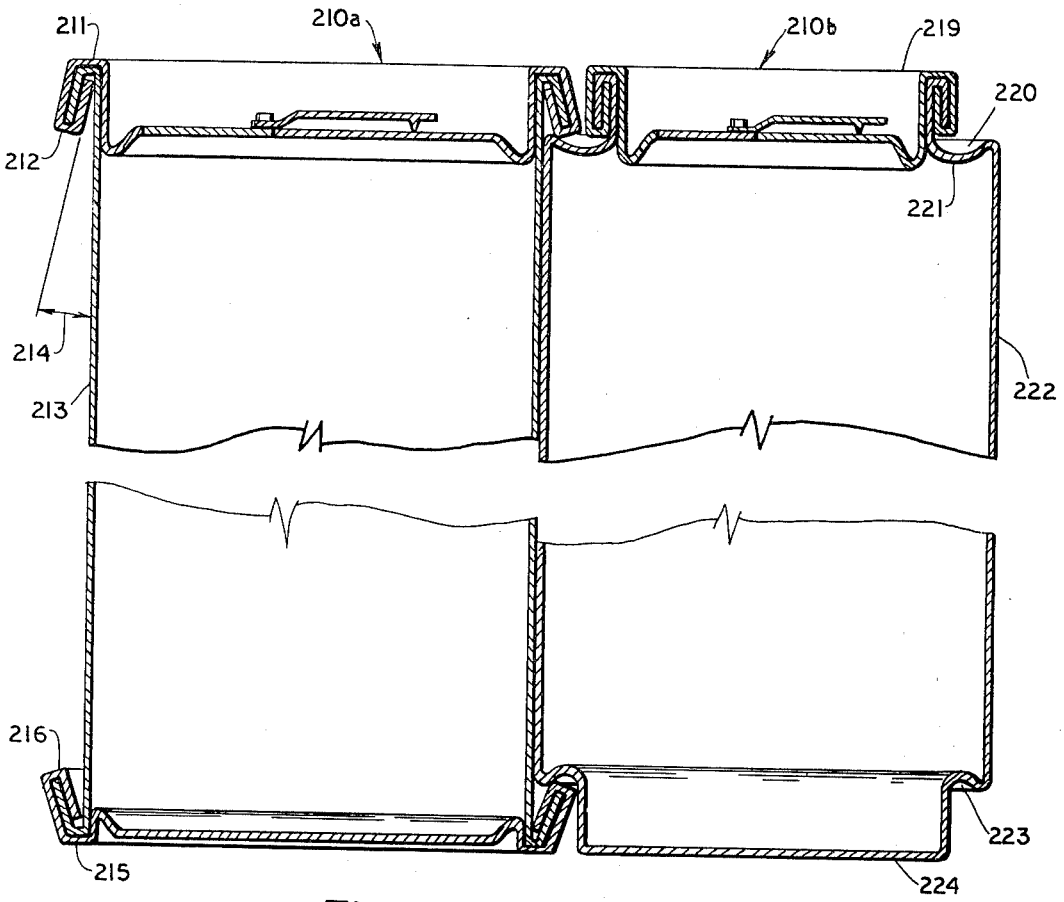
FIG. 4 is a vertical section view showing lateral connecting containers according to an alternative disclosed embodiment of the present invention.
Figure 5:
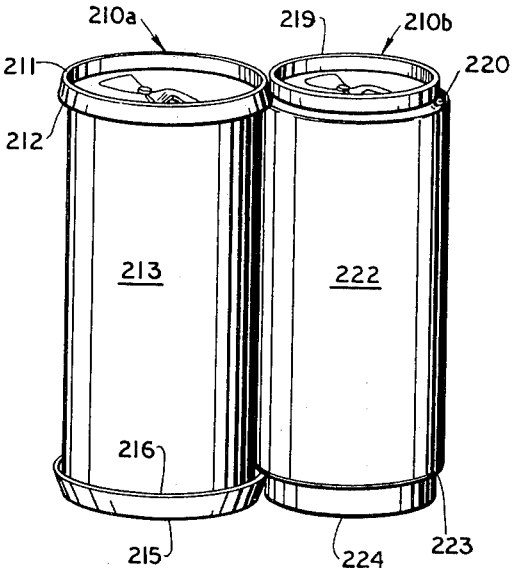
FIG. 5 is a pictorial view showing the interconnected containers of FIG. 4.

Another disclosed embodiment of laterally-connected dissimilar containers is shown in FIGS. 4 and 5, wherein are shown the containers 210*a* and 210*b* in the form of easyopen beverage containers. The top chime 211 of the container 210*a* has a curled portion 212 circumferentially surrounding the container body 213 and angularly displaced at an acute angle from the container body as indicated at 214. The bottom chime 215 of the container 210*a* has a similar curled portion 216 which is also angularly displaced outwardly from the body 213.

The top chime 219 of the container 210*b* is disposed radially inwardly of and surrounded by a circumferential, longitudinally outwardly-facing channel 220 formed by the depressed portion 221 of the container body 222. A similar annular and longitudinally outwardly-facing channel 223 is formed adjacent and circumferentially surrounding the bottom end 224 of the container 210*b*. The channels 220 and 223 provide recesses for snap-in engagement with the corresponding outwardly-angled curled portions 212 and 216, respectively, on the top chime 211 and the bottom chime 215 of the container 210*a*, in the manner shown in FIG. 4. It will also be apparent that more than two containers of the type shown in FIGS. 4 and 5 can be connected together to provide a multipack container assembly of the type depicted in FIG. 3.

Figure 6:
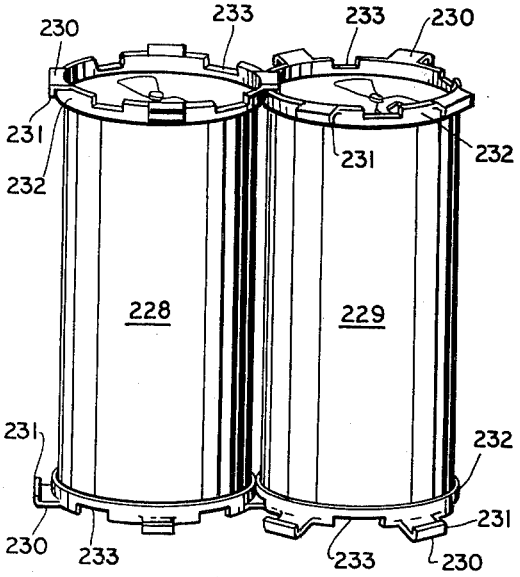
FIG. 6 is a pictorial view showing lateral-connecting containers according to another disclosed embodiment of the present invention.

The laterally-connecting container embodiment shown in FIG. 6 uses similar containers 228 and 229. Each end chime of the containers 228 and 229 has a number of engagement members 230 which extend radially outwardly from the chime and terminate in a longitudinal inwardly-turned hook portion 231 spaced apart a distance from the outer periphery 232 of the chime. Interposed between each of the engagement members 30 is a recess 233 formed in the end of the corresponding chime and of proper dimension to receive the hook portion 231 of an engagement member 203. As shown in FIG. 6, two or more of the containers 228, 229 are side-connected by appropriate engagement of hook portions 231 with recesses 233 of adjacent containers.

Figure 8:
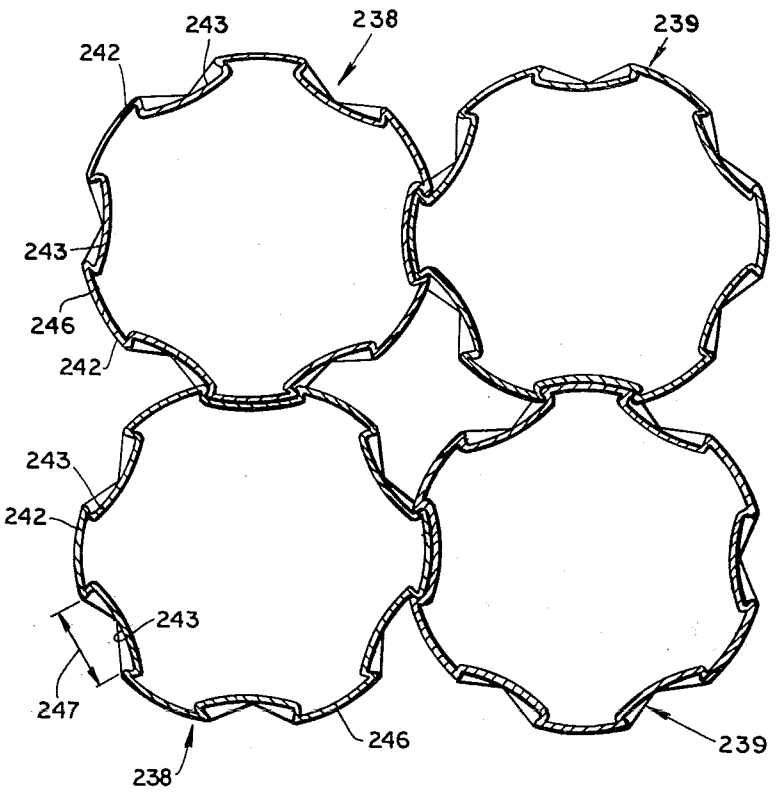
FIG. 8 is a plan section view taken along line 36—36 of FIG. 7, showing the lateral connection interrelationship.
Figure 7:
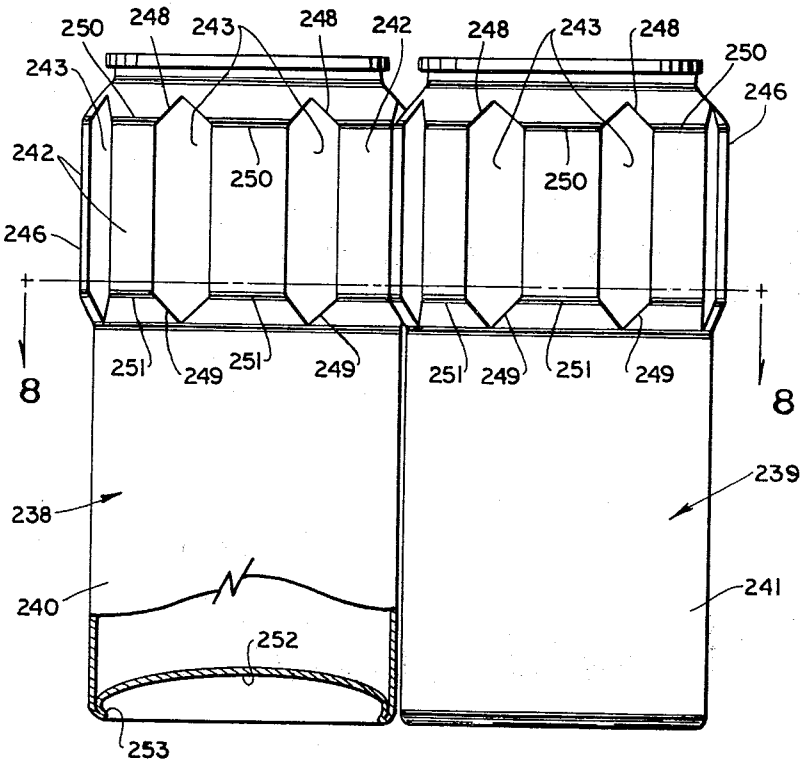
FIG. 7 is an elevation view of lateral-connecting identical containers according to another disclosed embodiment of the present invention.
Figure 9:
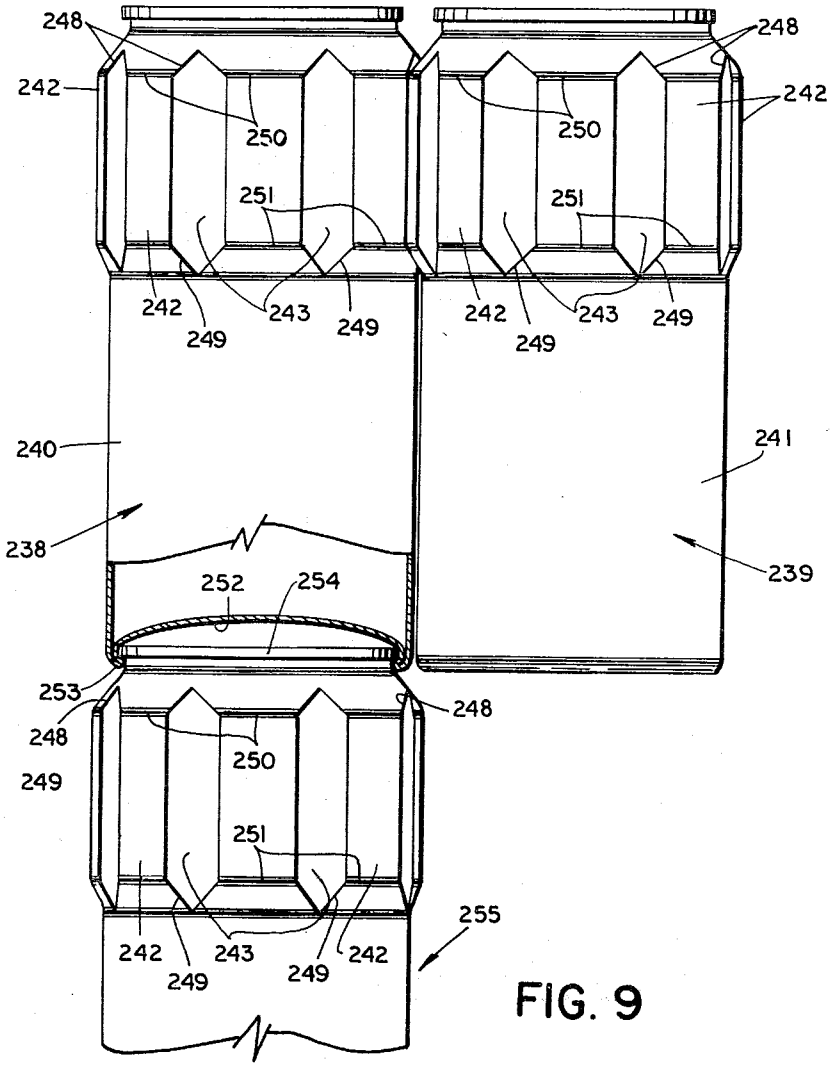
FIG. 9 is an elevation view showing a disclosed example of both lateral-connecting and end-connecting containers in multiple package arrangement, according to the present invention.

The disclosed embodiment of laterally-connecting container apparatus shown in FIGS. 7–9 utilizes similar connective structure and does not require specialized chime construction for the side connection. Turning to FIG. 7, the two identical containers 238 and 239 have bodies 240 and 241 which may be cylindrical over a substantial longitudinal extent. Disposed on the body of each container 238 and 239, adjacent the top ends thereof in the depicted embodiment, is the lateral connective region provided by a plurality of circumferentially spaced-apart rib members 242 each of which is generally elongate in configuration and extending longitudinally along the body of the container, with each rib member projecting radially outwardly of the nominal diameter defined by the cylindrical body 240 of the container 238, for example.

Interposed between each spaced-apart rib member 242, and radially recessed relative to the outermost extent of such rib members, is a plural number of elongate channels 243. The innermost diameter defined by the channels 243 can be substantially the nominal diameter of the container body 240.

Each of the rib members 242, as best shown in FIG. 8, has an outermost surface 246 having a circumferential extent which is slightly greater than the outermost spacing 247 of each channel 243. It is also seen in FIG. 8 that each of the channels 243 has an inner circumferential spacing which is slightly greater than the outermost spacing 247, and the inner circumferential spacing is preferably sufficient to receive a rib member 242 in complementary fit within a channel 243 as shown in FIG. 8. Assuming that the containers 238 and 239 are made of thin-gauge metal, as is conventional with the fabrication of beverage cans and similar containers, the rib members 242 and channels 243 have sufficient elastic resilient qualities to enable rib members to be snapped into and out of channels. Since the containers are laterally connected after the containers have been filled, the contents of the container provide internal support which prevents the body of the container from being irreversibly deformed during lateral connection.

Each of the elongate channels 243 has ends 248 and 249 that are closed or at least of restricted cross-section, relative to channel regions intermediate the ends. Each of the ribs 242 is complementary to the channels 243, so as to be laterally receivable within the channels, and the ribs have ends 250 and 251 which contact the channel ends 248 and 249 to prevent longitudinal sliding disengagement of laterally-connected containers 238 and 239.

Returning to FIG. 7, it is seen in the broken-away portion of the container 238 that the bottom end 252 of that container is surrounded by a bottom chime 253 having an inwardly-facing circumferential lip. Referring to FIG. 9, it is seen that the bottom chime 253 is selectively engageable for snap-in connection surrounding a top chime 254 of a container 255, so that end-connection and lateral-connection are both provided in a single type of similar container according to the present invention. It will be apparent, moreover, that combined lateral and end connection of containers is not limited to the specific types of end-connection and lateral-connection depicted in FIG. 9, and that alternative embodiments of end and lateral connections according to the present invention may be used to provide containers which can be combined in lateral and end connection to provide various configurations of interconnected container groupings.

Figure 10:
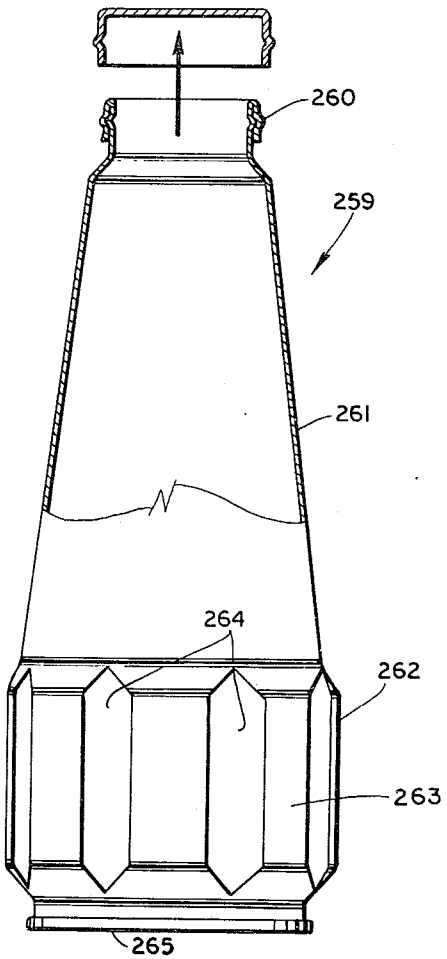
FIG. 10 is an elevation view showing a bottle form of identical lateral-connecting container according to another disclosed embodiment of the present invention.

The embodiment depicted in FIG. 10 illustrates an example of a non-cylindrical lateral-connecting container according to the present invention. The container 259, which may be made of metal as typically used for beverage cans and the like, tapers from the capped top end 260 downwardly along a body portion 261, having a shape resembling a truncated cone. The body portion 261 joins an interconnecting region 262 having alternating rib members 263 and channels 264, similar to the corresponding elements shown in FIG. 7. The container 259 terminates at its lower end in a base 265. It will be understood that a plural number of the containers 259 can be interconnected together in lateral relation by snap-in engagement of rib members 263 with corresponding adjacent channels 264.

Although the embodiments of FIGS. 7 –10 utilize lateral connective structure which extends along the longitudinal axis of the containers, other configurations of laterally-extending mutually interlocking projections and indentations can be employed without criticality residing in the longitudinal extent of such interlocking elements. For example, mutually interlocking laterally-extending elements can be provided in the general shape of a diamond as seen in vertical elevation view.

The use of metal containers in the disclosed embodiments is by way of example only, since the teachings of the present invention are applicable to nonmetallic containers made of a material having sufficient elastic deformability to provide the snap-in connection and disconnection described herein. Containers that are blow-molded of suitable plastic materials are one example of such nonmetallic containers.

It will be understood, moreover, that the foregoing description relates to specific disclosed embodiments of the present invention, and that numerous alterations and modifications may be made therein without departing from the spirit and the scope of the invention as defined in the following claims.

What is claimed is:

1. Container apparatus with mutually engagable structure which maintains filled beverage containers in side-by-side connection, comprising:

a pair of closed containers each of which has a generally cylindrical body portion terminated at each end by a closure member;

first attachment means integrally associated with one of said ends of one said container and extending laterally outwardly from said cylindrical body portion second attachment means integrally associated with said other container in peripheral surrounding relation therewith and presenting an engagement portion facing laterally outwardly from said cylindrical body portion of said other container;

one of said attachment means defining a circumferential channel which extends longitudinally a distance along the body portion of the corresponding container; and the other of said attachment means having a configuration which is complementary to said channel and which is laterally retained within said channel for snap-out removal thereform, to selectively retain said pair of containers in lateral connection relations.

2. Container apparatus as in claim 1, wherein:

said one attachment means includes a projecting means extending from said one end of said one container at an acute angle to said body portion of said one container and facing toward the other end of said one container to define said channel; and said second attachment means comprises a recess disposed at a peripheral location on an end of said other container and aligned to receive and be retainingly engaged by said projecting means of said one container.

3. Container apparatus as in claim 1, wherein:

each of said first and second attachment means comprises a plurality of spaced apart laterally extending rib means disposed on said generally cylindrical body portion;

each of said rib means having an outer portion and an inner portion, and the spacing between inner portions of two adjacent rib means on a said container accommodating said outer portion of a rib means on another said container;

the spacing between outer portion of said two adjacent rib means being less than the spacing necessary to accommodate said outer rib portion; and said rib means being elastically deformable to an extent sufficient to allown a rib outer portion to laterally enter and be retainingly received within said inner portion between two adjacent rib means.

4. Container apparatus with mutually engagable structure comprising:

a pair of closed containers each of which has a generally cylindrical body portion terminated at each end by a closure member;

first attachment means positioned at one of said ends of one said container and extending laterally outwardly from said cylindrical body portion;

second attachment means positioned on said other container in peripheral surrounding relation therewith and presenting an engagement portion facing laterally outwardly from said cylindrical body portion of said other container;

said first and second attachment means being mutually complementarily engagable with each other to selectively retain said pair of containers in lateral connected relation;

each end of said one container has a chime portion comprising said first attachment means;

each end of said other container has a peripheral rim spaced radially outwardly from the body portion of said other container;

each said peripheral rim of said other container having a portion facing generally toward the opposite end of said other container; and said rim portions of said other container being spaced apart from each other a distance which permits said chime portions of said one container to be laterally disposed therewithin for retaining engagement therebetween.

5. Container apparatus as in claim 4 wherein at least one of said chime portions and said rim portions present a serrated surface for said complementary retaining engagement of said containers.

6. A container for lateral interconnection with like containers while filled with a pressurized beverage, comprising:

an elongate body terminated by a pair of end members in pressure sealing relation with said body;

a portion of said elongate body having substantially cylindrical configuration;

a plurality of outwardly facing elongate channels integrally formed in and extending laterally inwardly from said cylindrical portion of said elongate body;

said cylindrical portion including longitudinally extending ribs serially interposed between said elongate channels and extending laterally outwardly from said cylindrical portion;

each of said ribs being configured for lateral interconnective engagement and disengagement with a said elongate channel in another such container;

at least one of said ribs and the sides of said elongate channels being elastically deformable to allow said ribs to be lockingly laterally received within and laterally removable from said elongate channel; and said elongate channels being closed at longitudinally spaced apart ends to prevent said ribs from being longitudinally removed from said elongate channels.

* * * * *